United States Patent [19]

King

[11] Patent Number: 4,825,494

[45] Date of Patent: May 2, 1989

[54] WETLAND CROSSING BRIDGE ASSEMBLY

[75] Inventor: John B. King, Winston Salem, N.C.

[73] Assignee: Pace Technologies, Inc., Winston-Salem, N.C.

[21] Appl. No.: 202,385

[22] Filed: Jun. 6, 1988

[51] Int. Cl.[4] ..... E01D 15/12

[52] U.S. Cl. ..... 14/73; 14/75; 404/43; 404/70

[58] Field of Search ..... 14/1, 4, 6, 14, 17, 14/73, 75; 404/43, 44, 70, 71; 52/604, 606, 608, 251

[56] References Cited

U.S. PATENT DOCUMENTS

| | | | |
|---|---|---|---|
| 33,610 | 10/1861 | Stebbins | 404/43 |
| 909,792 | 1/1909 | Henderson | 404/44 X |
| 3,290,843 | 12/1966 | Wermen | 52/604 X |
| 3,691,710 | 9/1972 | Gilbert et al. | 52/251 |

*Primary Examiner*—Jerome W. Massie
*Assistant Examiner*—Matthew Smith
*Attorney, Agent, or Firm*—Hurt, Richardson, Garner, Todd & Cadenhead

[57] ABSTRACT

A wetland crossing bridge assembly is disclosed having a plurality of interconnected lower box support members with upstanding columnar members extending from the base thereof. Slab members are laid on the top of these column members in an overlapping arrangement and side members having a general L-shaped configuration line on each side. A conventional road surface is applied over the structural members. The structure allows the bridge assembly to absorb or dissipate stress from shifting caused by wind, water levels, etc. and the even weight distribution through the interlocking arrangement allows construction without requiring pilings sunk to underlying bedrock and with minimal adverse environmental impact.

13 Claims, 3 Drawing Sheets

WETLAND CROSSING BRIDGE ASSEMBLY

BACKGROUND OF THE INVENTION

Bridges connecting roads which span wetland areas, for example, coastal marshland, face a major obstacle with regard to the footings which support the bridge structure in that a relatively solid base, such as that provided by dry land, is either difficult or too expensive to access. In many cases, forms for pilings must be driven down a great distance to access bedrock, requiring the use of large, heavy, and complex machinery for drilling and for setting the pilings which support the bridge.

In addition to the problems associated with supporting the bridge, many of the wetland areas which are to be spanned are extremely environmentally sensitive. A major disruption of the environment such as that occasioned by conventional bridge building methods can damage or destroy the wetland area. While roadways and concomitant access are important considerations, the preservation of the environment and plant and animal life are also important considerations. Federal and state regulations often dictate against major disruption of environmentally sensitive areas, and compliance with such regulations often limits or prevents development efforts.

Striking a balance between the above-mentioned, often competing considerations, may be difficult or impossible to attain given conventional technology and environmental regulations which have been enacted. Thus, a need exists in the art for a means to span sensitive areas while effecting a minimum disruption of the environment.

SUMMARY OF THE INVENTION

It is, therefore, one of the principal objects of the present invention to provide a wetland crossing bridge assembly that combines a functionally safe and secure bridge with a minimum of disruption to the environment in which the assembly is installed.

Another object of the present invention is to provide a bridge assembly which does not require support pilings that extend to underlying bedrock, and which utilizes materials for its construction which are environmentally inert.

A further object of the present invention is to provide a bridge assembly which can be easily manufactured away from or at the the job site and can then be easily installed on site.

A still further object of the present invention is to provide for a minimum of disruption to the wetland area during construction of the present bridge assembly, and which assembly is durable to provide a long service life.

These and additional objects are attained by the present invention which relates to a wetland crossing bridge assembly having interlocking support members including base portions with a plurality of radially extending support columns projecting upwardly therefrom. Plate members adapted to rest on said support columns in an alternately overlapping arrangement are provided as a roadbed receiving surface which provides the assembly with the ability to withstand movement or shifting. Generally L-shaped side members are provided for installation along each side of the bridge assembly. Means are also provided for connecting the L-shaped members in an interlocking manner and a suitable drainage means is provided for the finished assembly.

The structural members of the present assembly are normally formed from an inert concrete or like material although other suitable building materials may be used depending on the environmental conditions and/or requirements. With the support structure in place, conventional roadbed materials such as gravel and asphalt are normally applied thereover for forming the road surface.

Various other objects and advantages of the present invention will become apparent from the following detailed description, with reference to the accompanying drawings.

DETAILED DESCRIPTION OF THE PREFERRED EMBODIMENT

Figure 1:
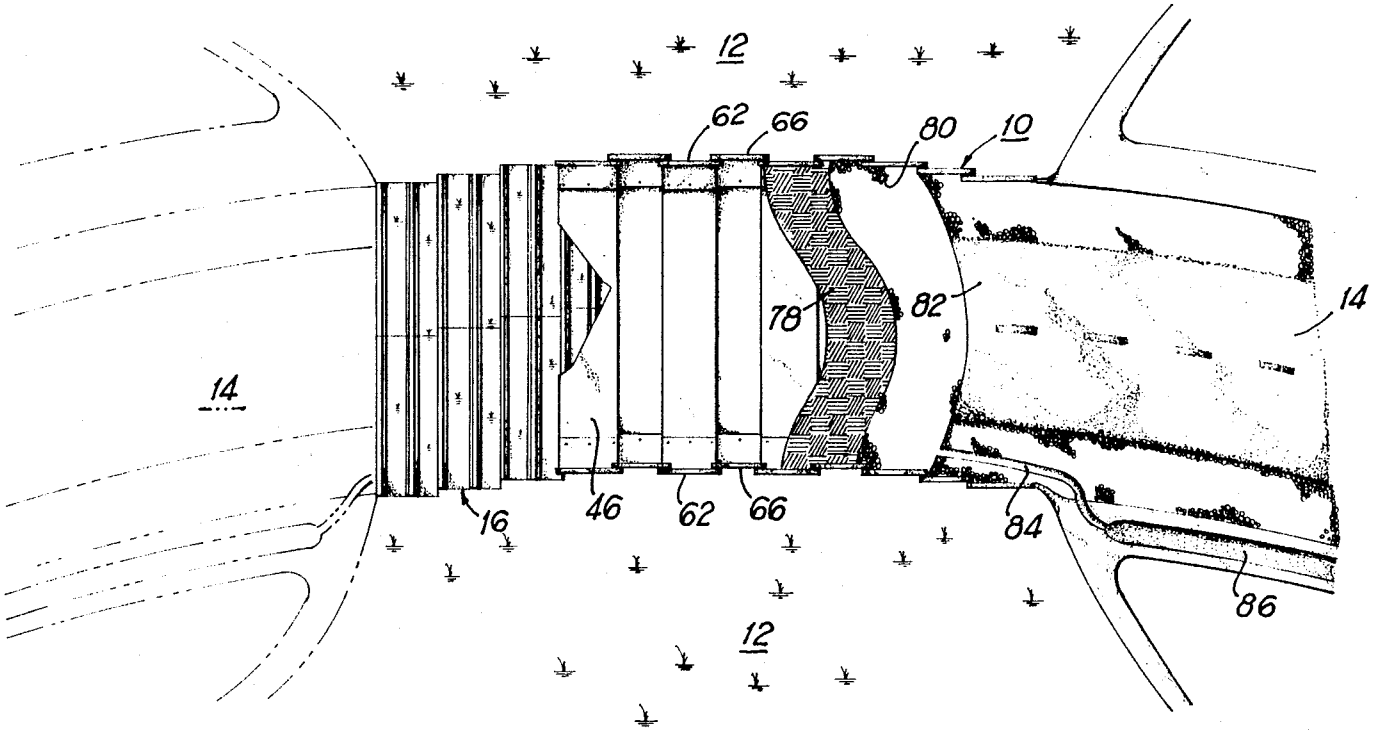
FIG. 1 is a top plan view of the wetland crossing assembly of the present invention, shown in installed position with portions thereof broken away to show the stages of construction.

Referring now more specifically to the drawings, and to FIG. 1 in particular, numeral 10 designates generally the wetland crossing bridge assembly of the present invention, shown here in installed position spanning a wetland area 12 and connecting the opposing ends of roadway 14. The wetland area 12 represents marshland, such as that commonly found in low-lying coastal areas, and one in which the indigenous plant and animal life are normally particularly sensitive to the environment. Conventional bridge construction in such an area would be severely damaging or destructive to the delicate ecosystem in drilling down to underlying bedrock for sinking bridge pilings. The present invention, however, is particularly well-suited for such areas, the assembly being designed to rest below the waterline on the exposed surface of the marsh with only about 12 to 18 inches of the upper vegetable soil removed, with support means for the roadbed projecting above the waterline.

Figure 2:
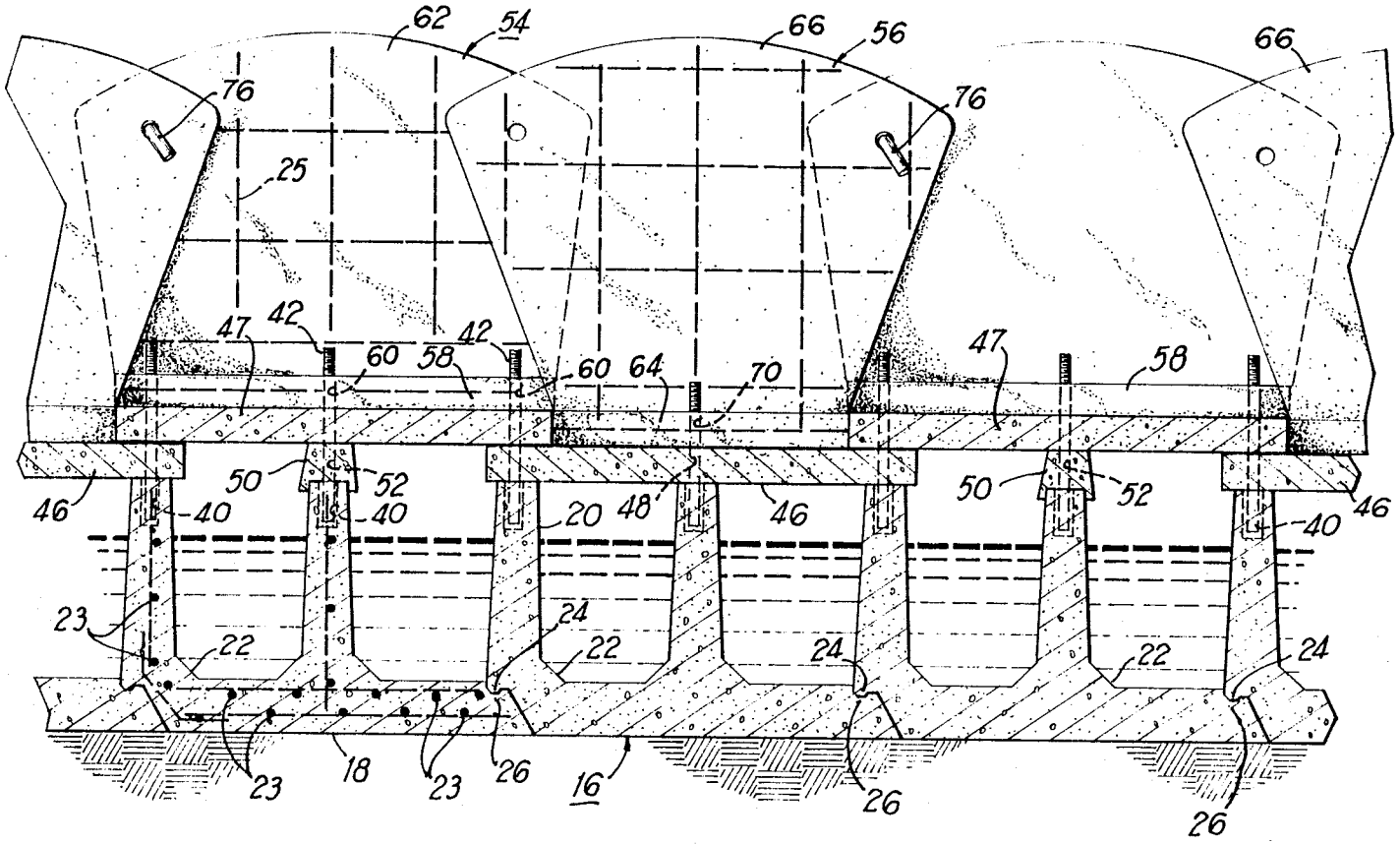
FIG. 2 is a partial, side elevational view, shown partially in cross-section, of the structural members of the present invention, shown here prior to the application of the overlying roadbed.
Figure 3:
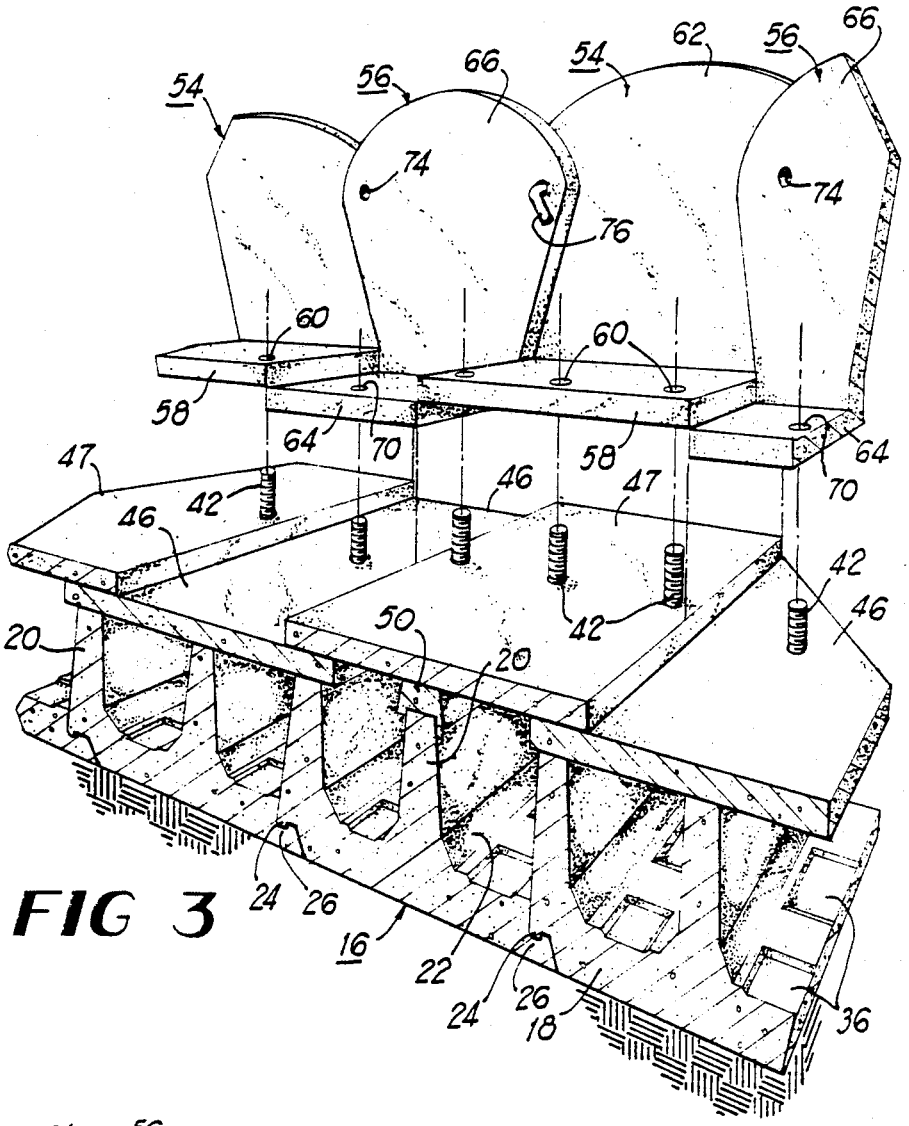
FIG. 3 is an exploded, partial perspective view of the structural components of the present invention.

FIG. 2 and 3 illustrate in detail the structural components of the present assembly, bottom support box members 16 including generally rectangular, flat bottomed base portions 18 with generally vertical support column means projecting upwardly therefrom. Each box member 16 has two vertical column means, an end column 20 extending upwardly from one of the edges of the base portion 18 and a central column 21 extending upwardly from the approximate center of the base portion. Each of the box members 16 are virtually identical, being pre-cast in forms off-site or cast-in place at the construction site. The columnar members extend horizontally throughout the width of the box members, the bases of the columns 20 and 21 being reinforced at the intersection thereof with the base portions 18, reinforcement being provided by angular ramp means 22, integrally cast during the formation of the box members.

The box members 16 and the other structural members to be described hereinbelow are normally formed from concrete, any suitable mixture including portland cement, aggregates, and other admixtures being satisfactory; however, it is desirable that the concrete mixture attain a minimum compressive strength at 28 days or less of 3,500 p.s.i. and that the proportion of portland cement in the mixture be at least 564 in. per yard of concrete. Reinforcement throughout the members is provided by a combination of steel bars 23 and single or multiple layers of welded wire fabric 25, depending on the depth at any particular point.

The box members are formed with male and female ends, the male end corresponding to the end having the end support columns 20 extending therefrom. The male end includes a hook-like projection 24, extending downwardly relative to the columnar member 20, the male end forming a generally inverted V-shape. The opposite, or female end includes a trough 26 for receiving projection 24 of the adjacent box member, the female end forming generally a V-shape thereby receiving in nested relationship the inverted, V-shaped male end.

The nested relationship of the box sections 16 provides an interconnected base structure for the present bridge assembly that distributes the overall weight of the assembly over the entire structure. This is both necessitated by the nature of the relatively soft surface upon which the bridge rests and by requirements which dictate minimal disturbance to the underlying strata. In addition, as shown in FIG. 2, the structure produces minimal adverse impact on the free flow of water through the wetland, thus complying with federal and state laws and the standards set by the Army Corps of Engineers and Coastal Management Agencies which must be met before construction permits can be obtained.

Referring to FIGS. 2 and 3, it will be seen that, during the casting of the box sections 16, regularly spaced recesses 36 are formed in the upper surface of the base portions 18 between the columns, being generally centrally located therebetween, to reduce the overall weight of the sections without sacrificing either strength or stability. Also formed in the casting process or by drilling thereafter, are apertures 50 which extend downwardly into the columnar members near the outer edges thereof. The apertures receive rod means 42, which may be bolts, pins, bars, or their equivalent and which extend upwardly therefrom. As shown, the diameter of the apertures 50 is greater than the diameter of the rod means 42, such that the rod means are loosely received therein.

Figure 4:
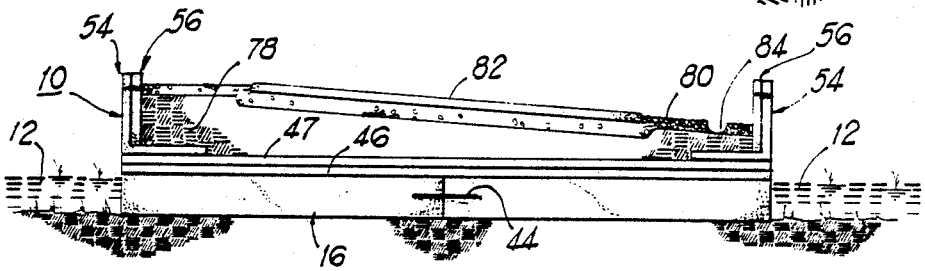
FIG. 4 is a cross-sectional view of the completed bridge assembly, the section being taken on line 4—4 of FIG. 1.

Referring to FIGS. 1 and 4, the required width of a two-lane roadway can be accommodated with two box sections 16 disposed in side-by-side relationship. The box sections are fastened together by expandable butterfly plates, connecting bars, or pins 44 which extend into each of the abutting base portions 18 and are secured therein by cementing, pressure fitting, or other suitable means. It can also be seen that curved roadways can be easily accommodated by appropriate, sequential offsetting or staggering of the box sections.

As shown best in FIGS. 2 and 3, disposed on top of the columnar members are slab members 46 and 47, which are also pre-cast and suitably reinforced as described hereinabove for the box sections. The slabs are also essentially identical, but are referred to as lower slabs 46 and upper slabs 47, as an aid to understanding the description and drawings. Where reference numerals are not specified, but reference is made to "slabs" or "slab members," the description is meant to include both upper and lower slabs. The slabs are normally of a width sufficient to completely span three consecutive columnar members and normally of a length sufficient to extend longitudinally across two box sections which are abutted in side-by-side relationship.

The slabs include a plurality of apertures 48 near each of the outer edges thereof, which are either formed in the casting process or drilled thereafter, and which loosely receive the upwardly extending rod means 42 for securing the slabs in place over the box sections 16. The slabs are alternately placed on top of the columnar members 20 and 21 in overlapping relationship. The lower slabs completely over 46 span consecutive box members 16, being disposed directly on top of the columnar members, extending completely over one end column 20, over a central column 21, and then over the next succeeding end column 20. The central columnar member 21 between the spanned box sections is fitted with an elongated cap member 50, having a generally inverted U-shape to engage the upper end of the column, and a thickness from this upper column end consistent with the thickness of the slabs.

The upper slabs 47 are then laid over the lower slabs, the outer edges thereof overlapping the opposed outer edges of consecutive lower slabs. The upper slabs are supported along their central portions by cap members 50 and are secured in place by rods 42, which extend therethrough at each end. Cap members 50 are also provided with apertures 52 near the outer edges thereof for loosely receiving rod means 42.

The main structural components of the bridge, just described, are thus designed with the ability to shift or move relative to one another to withstand such environmental factors as high winds and shifting water levels, among others. This ability is especially advantageous in coastal regions and is provided through a combination of the overlapping arrangement of the slab members, the planar interfaces between adjacent components, and the loose disposition of the rod means 42 in the corresponding apertures. This same ability is, at the same time, balanced by the resistance to movement provided by the securing rod means, friction between adjacent components, and the overall distributed weight of the main structural components. Thus, many advantages are afforded by the present invention which have been heretofore unknown in the art.

The bridge assembly is also provided with generally L-shaped, concrete side members 54 and 56, best shown in FIGS. 2 and 3, which are installed along the outer periphery of each side of the bridge assembly. Side members 54 include a base portion 58, oriented in parallel relation to the installed slabs, and having a width consistent with that of the upper slabs 47, upon which the base portions 58 rest. The base portions 58 also include a plurality of apertures 60, which correspond with apertures 48 in the upper slabs, and which loosely receive rod means 42. Side member 54 also includes a fan-shaped upright wall portion 62, oriented in perpendicular relation to base portion 58, which forms a portion of the side wall or bridge railing.

Side members 56 include a base portion 64, oriented in parallel relation to the installed lower slabs 46, upon which the base portions 64 rest. The width of these base portions 64 is reduced relative to the width of base portions 58, so as to be received between the opposed edges of two consecutive upper slabs 47. Extending perpendicularly upward from base portions 64 are generally fan-shaped side wall portions 66, which, in installed position, are disposed adjacent the side wall portions 62 of members 54. As seen in FIG. 1, the side wall portions 66 are disposed outboard of portions 62 on one side of the bridge and on the opposite side, walls 62 are disposed outboard of walls 66, so as to permit relative movement therebetween, without any substantial disturbance to the adjacent wall portions.

Base positions 64 in general include a single aperture 70 for loosely receiving rod 42. The fan-shaped side walls 62 and 66 each include apertures 72 (not shown) and 74, respectively, disposed in and near each upper corner. The apertures are in communication when the side members are in installed position for loosely receiving generally L-shaped rods or pins 76. Thus, the side members are also designed to permit some shifting of the base members as described hereinabove, and of the side wall portions, for dissipating and/or absorbing stress, while the present bridge remains a cohesive assembly. It should also be noted that no nuts or other type of cap means or fasteners are normally used over or around rod means 42 or 76 for fastening purposes.

With the basic structure completed, the roadbed is applied thereover, generally including for example, a lower layer of earth 78, an intermediate layer of stone 80, and an upper layer of concrete or asphalt 82. For drainage purposes, a channel 84 is provided on the low side or sides of the bridge assembly. The channel leads to a culvert 86 into which the runoff flows and where it evaporates. Such a drainage system is usually necessitated by applicable laws or standards which prohibit runoff flowing directly from the bridge into the body of water beneath the bridge.

Thus, it will be readily apparent to those skilled in the art that a novel wetland crossing bridge assembly has been shown and described in detail herein. Various changes and modification may be made without departing from the scope of the present invention.

I claim:

1. A wetland crossing assembly for spanning bodies of water and the like and for receiving a conventional road surface thereover, comprising a plurality of bottom support box members disposed adjacent one another in a longitudinal row, each having a base portion for resting on the ground with a plurality of columnar members extending upwardly from each of said base portions, slab means resting on said columnar members and having a width sufficient to span at least a portion of two consecutive support box members for distributing the weight of said assembly, securing means disposed in said columnar members and extending in a generally vertical direction therefrom and through said slab means, side members disposed along each end of said slab members and having a base portion oriented in parallel relation to said slab means for resting thereon, and a wall portion disposed generally perpendicular to said slab means, said base portions of said side members also receiving said securing means, said assembly also including a roadbed overlying said slab means and said base portions of said side members for receiving traffic thereover.

2. A bridge assembly as defined in claim 1 in which said assembly includes a second row of said box members disposed adjacent said first row and extending in parallel relationship therewith.

3. A bridge assembly as defined in claim 1 in which said slab means are of a length sufficient to span at least two of said adjacent rows of said box members.

4. A bridge assembly as defined in claim 1 in which said columnar members, said slab means and said base portions of said side members include apertures formed therein, and said securing means include rod members having a diameter less than that of said apertures for being loosely received therein.

5. A bridge assembly as defined in claim 1 in which said box members include a male end and a female end, said male end having a generally inverted V-shaped projection extending downwardly therefrom and said female end having a generally V-shaped trough formed therein for receiving said male end in nested relationship therewith and interconnecting adjacent box members in a longitudinal row.

6. A bridge assembly as defined in claim 5 in which said columnar members, said slab means and said base portions of said side members include apertures formed therein, and said securing means include rod members having a diameter less than that of said apertures for being loosely received therein.

7. A bridge assembly as defined in claim 6 in which said slab means are of a length sufficient to span at least two of said adjacent rows of said box members.

8. A bridge assembly as defined in claim 1 in which a second series of slab means is provided for overlapping said first mentioned slab means.

9. A wetland crossing bridge assembly for spanning bodies of water and the like and for receiving a conventional roadbed thereover, said assembly comprising:

(a) a plurality of bottom support box members disposed adjacent one another in a plurality of longitudinal rows;

(b) said box members including a generally planar base portion for resting on the surface of the wetland below the water line and a plurality of generally vertical columnar members disposed generally perpendicular to said base portion, said columnar members extending to a point above the waterline;

(c) slab means disposed over said columnar members having a width sufficient to extend over said columnar members of at least two of said box members and a length sufficient to extend across at least two of said longitudinal rows;

(d) side members having a generally L-shaped configuration with the base section disposed on said slab means near the edge of said slab means on both right and left sides and a wall section extending upwardly from said base section in generally perpendicular relationship therewith; and (e) a conventional road surface laid over said slab means and said base sections for receiving traffic thereover.

10. A bridge assembly as defined in claim 9 in which said box members include a male end and a female end, said male end having a generally inverted V-shaped projection extending downwardly therefrom and said female and having a generally V-shaped trough formed therein for receiving said male end in nested relationship therewith and interconnecting adjacent box members in a longitudinal row.

11. A bridge assembly as defined in claim 9 in which said assembly includes securing means engaging said columnar members and extending upwardly therefrom through said slab means and said base sections of said side members for interconnecting the elements of said assembly.

12. A bridge assembly as defined in claim 11 in which said columnar members, said slab means and said base portions of said side members include apertures formed therein, and said securing means include rod members having a diameter less than that of said apertures for being loosely received therein.

13. A bridge assembly as defined in claim 9 in which a second series of slab means is provided for overlapping said first mentioned slab means.

* * * * *